US012390902B2

(12) United States Patent
Huber

(10) Patent No.: US 12,390,902 B2
(45) Date of Patent: Aug. 19, 2025

(54) METHOD FOR PRODUCING AN ABRASIVE ARTICLE, AND ABRASIVE ARTICLE

(71) Applicant: Robert Bosch GmbH, Stuttgart (DE)

(72) Inventor: Johannes Huber, Constance (DE)

(73) Assignee: Robert Bosch GmbH, Stuttgart (DE)

( * ) Notice: Subject to any disclaimer, the term of this patent is extended or adjusted under 35 U.S.C. 154(b) by 860 days.

(21) Appl. No.: 17/613,309

(22) PCT Filed: May 11, 2020

(86) PCT No.: PCT/EP2020/063001
§ 371 (c)(1),
(2) Date: Nov. 22, 2021

(87) PCT Pub. No.: WO2020/239414
PCT Pub. Date: Dec. 3, 2020

(65) Prior Publication Data

US 2022/0226966 A1 Jul. 21, 2022

(30) Foreign Application Priority Data

May 28, 2019 (DE) ..... 10 2019 207 822.2

(51) Int. Cl.
*B24D 11/00* (2006.01)
*B24D 18/00* (2006.01)

(52) U.S. Cl.
CPC ..... *B24D 11/005* (2013.01); *B24D 11/001* (2013.01); *B24D 18/0072* (2013.01)

(58) Field of Classification Search
CPC ..... B24D 11/005; B24D 18/0072
See application file for complete search history.

(56) References Cited

U.S. PATENT DOCUMENTS 2,248,853 A * 7/1941 Carlton ..... B24D 11/005 51/298
2,287,837 A 6/1942 Smyser
2,318,570 A * 5/1943 Carlton ..... B24D 11/005 118/640
2,715,074 A 8/1955 Hirschberger
(Continued)

FOREIGN PATENT DOCUMENTS

CN 102574205 A 7/2012
CN 102665988 A 9/2012
(Continued)

OTHER PUBLICATIONS

International Search Report corresponding to PCT Application No. PCT/EP2020/063001, mailed Aug. 7, 2020 (German and English language document) (7 pages).
(Continued)

*Primary Examiner* — Alexandra M Moore
(74) *Attorney, Agent, or Firm* — Maginot, Moore & Beck LLP

(57) ABSTRACT

The disclosure relates to a method for producing an abrasive article, in which method a granular substance is scattered onto an abrasive article substrate that is coated with a binder, wherein the granular substance is deagglomerated by gas pulses and the deagglomerated granular substance is scattered onto the abrasive article substrate. The disclosure further relates to a correspondingly produced abrasive article.

18 Claims, 5 Drawing Sheets

(56) References Cited

U.S. PATENT DOCUMENTS

| | | | | |
|---|---|---|---|---|
| 7,217,444 | B2 * | 5/2007 | Hays | B05B 5/082 427/458 |
| 2014/0106126 | A1 | 4/2014 | Gaeta et al. | |

FOREIGN PATENT DOCUMENTS

| | | | |
|---|---|---|---|
| CN | 103313800 | A | 9/2013 |
| CN | 105415216 | A | 3/2016 |
| CN | 107263340 | A | 10/2017 |
| CN | 107787264 | A | 3/2018 |
| CN | 108290275 | A | 7/2018 |
| EP | 0 071 771 | A1 | 2/1983 |
| EP | 0 137 711 | A1 | 4/1985 |
| EP | 1 208 945 | A1 | 5/2002 |
| WO | 2014/206967 | A1 | 12/2014 |
| WO | 2018/118690 | A1 | 6/2018 |
| WO | 2018/207145 | A1 | 11/2018 |

OTHER PUBLICATIONS

Lu, X. et al., "Fabrication of micro-fine high Nb-containing TiAl alloyed powders by fluidized bed jet milling," Rare Metals, Feb. 2012, vol. 31, No. 1, pp. 1-6 (6 pages).

Yang, J. et al., "Powder Engineering", Dec. 2005, 1st ed., p. 264, Hefei University of Technology Publishing House, Hefei China.

Li Binhuai., "Pre-Decomposition Cement Production Technology and Operation", Jan. 2011, 1st ed., pp. 262-263, Wuhan University of Technology Press, Wuhan.

* cited by examiner

METHOD FOR PRODUCING AN ABRASIVE ARTICLE, AND ABRASIVE ARTICLE

This application is a 35 U.S.C. § 371 National Stage Application of PCT/EP2020/063001, filed on May 11, 2020, which claims the benefit of priority to Serial No. DE 10 2019 207 822.2, filed on May 28, 2019 in Germany, the disclosures of which are incorporated herein by reference in their entirety.

The disclosure relates to a process for producing an abrasive article, in which an abrasive article substrate coated with binder is sprinkled with a particulate substance, in particular with abrasive grains.

BACKGROUND

Processes for producing abrasive articles, in which an abrasive article substrate coated with binder is sprinkled with a particulate substance, in particular with abrasive grains, are already known. Such processes are known, for example, from WO 2014/206967 A1.

Furthermore, it is known from the prior art that, in order to produce particularly fine abrasive articles which when used in a grinding process produce very low peak-to-valley heights, a single layer of abrasive grains can firstly be formed on the abrasive article. Binders which when applied to an abrasive article substrate form a sticky but not flowable film are typically used for this purpose. Abrasive grain agglomerates are subsequently sprinkled on this film, with excess abrasive grains (which are, in particular, formed from the agglomerates sprinkled on) being blown off, knocked off, brushed off or washed off after curing of the binder. In this way, it is possible to produce an abrasive article having a closed, i.e. virtually gap-free, surface of sprinkled-on abrasive grains. Open scattering, i.e. production of a surface which is not closed by abrasive grains on the abrasive article, is not possible using this process of the prior art.

SUMMARY

A process for producing an abrasive article, in which an abrasive article substrate coated with binder is sprinkled with a particulate substance, in particular with abrasive grains, is proposed. According to the disclosure, the particulate substance is deagglomerated by gas pressure pulses, in particular to give individual grains, and the deagglomerated particulate substance, in particular the individual grains, is/are sprinkled onto the abrasive article substrate.

An abrasive article is employed for grinding work on a workpiece and comprises at least one abrasive article substrate and abrasive grains arranged on at least one side of the abrasive article substrate. The abrasive article can be, in particular, a coated abrasive article. Furthermore, alternative abrasive articles, for example bonded abrasive articles, are also conceivable in principle. Bonded abrasive articles are, in particular, typically synthetic resin-bonded cutting and grinding disks, with which a person skilled in the art will be familiar. To produce synthetic resin-bonded cutting and grinding disks, a composition is produced by mixing abrasive minerals together with fillers, pulverulent resin and liquid resin and this composition is then pressed to give cutting and grinding disks having various thicknesses and diameters. In particular, the cutting and grinding disks also comprise woven fabric layers composed of glass fibers. Curing of the composition typically occurs at about 180° C. In combination with the process of the disclosure, advantages according to the disclosure can also be achieved in the case of such abrasive articles.

The abrasive article comprises an abrasive article substrate, in particular a flexible abrasive article substrate, having at least one layer. The abrasive article substrate can comprise, in particular, paper, paperboard, Vulcan fiber, foam, a polymer, a textile structure, in particular a woven fabric, formed-loop knitted fabric, drawn-loop knitted fabric, braid, nonwoven, or a combination of these materials, in particular paper and woven fabric, in one or more layers. The abrasive article substrate, in particular flexible abrasive article substrate, imparts specific properties in respect of adhesion, extensibility, tear and tensile strength, flexibility and stability to the abrasive article. In a coated abrasive article, abrasive grains are fixed to the abrasive article substrate by means of a binder (often referred to as base binder). The particulate substance, in particular the abrasive grains, are at least prefixed, in particular fixed, by means of the binder on the abrasive substrate, in particular in a desired position and/or distribution. Proceeding from the prior art, suitable binders for fixing a particulate substance, in particular abrasive grains, on the abrasive article substrate are known to a person skilled in the art. Such binders of the prior art are typically solvent-based adhesives such as polychloroprenes. In addition to the binder as base binder, a further "covering binder" can be used; this is, in particular, applied layerwise over the particulate substance, in particular abrasive grains, fixed by means of the base binder on the abrasive substrate. Here, the covering binder joins the grains of the particulate substance firmly to one another and firmly to the abrasive substrate. Suitable covering binders are, in particular, adequately known to a person skilled in the art from the prior art. Possible covering binders are, in particular, synthetic resins such as phenolic resin, epoxy resin, urea resin, melamine resin, polyester resin. In addition, further additives ("abrasive additives") can be provided in order to impart specific properties to the abrasive article. Such additives are well known to a person skilled in the art.

It is proposed that the process of the disclosure be realized, in one embodiment, as a roll-to-roll process, with the abrasive article substrate being provided in the form of an abrasive article substrate web roll and used, in particular sprinkled with a particulate substance, and subsequently rolled up on an abrasive article web roll. In particular, an abrasive article is produced in the form of an abrasive article web in this way. The term web is used here to refer to an embodiment of the abrasive article substrate which is extended in a preferential direction and has been or is typically rolled up on a roll.

The abrasive article has a surface provided for grinding, i.e. an abrasive surface, in particular on the side of the abrasive article on which abrasive grains have been fixed by means of the binder, in particular by means of the base binder, and have optionally been provided with a covering binder and/or a further additive. The abrasive surface of the abrasive article is moved over a workpiece to be worked during a grinding operation, so that a grinding action is generated by means of the abrasive grains arranged on the abrasive surface. The abrasive article can in principle be present in various manufactured forms, for example as abrasive disk or as abrasive band, as sheet, roll, strip or else as abrasive article web (e.g. during production). In particular, the abrasive article can be produced for use with grinding machines such as excentric grinding machines or else for manual grinding. For example, the abrasive article can be in the form of a hand-held abrasive sheet, abrasive band or abrasive disk laminated with velour.

A "particulate substance" is, in particular, a pulverulent material, a powder or another, particulate bulk material. In an embodiment of the process, the particulate substance comprises abrasive grains and/or abrasive additives. As an alternative, the particulate substance consists of abrasive grains and/or abrasive additives. In one embodiment of the process, the particulate substance has an average particle size in accordance with the FEPA standard of less than 300 microns, in particular less than 100 microns, very particularly preferably less than 50 microns.

A "gas pressure pulse" is a dynamic pressure change resulting from a flowing gas, in particular a pressure wave or the like, caused by a flowing gas. In an embodiment of the process, the gas pressure pulses have a pressure of more than 0.5 bar, in particular more than 2 bar, very particularly preferably more than 5 bar. A gas pressure pulse can be produced, for example, using a pressurizing unit or compressor by firstly producing a gas under high pressure and subsequently releasing it suddenly in a particular direction. In particular, a gas pressure pulse can, for example, be produced by means of a gas pressure nozzle in combination with a valve. The valve in particular makes precise and rapid metering of the gas pressure pulse possible and the gas pressure nozzle makes bundling of the gas pressure pulse in a particular direction possible. In an embodiment of the process, the gas pressure nozzle produces a gas pressure pulse in the form of a free jet having an opening angle (defined as width at half height of a Gaussian profile describing the free jet) of less than 70°, in particular less than 50°, very particularly preferably less than 35°. In an embodiment of the process, the gas pressure pulses have an average duration (pulse duration) in the range from 0.5 to 30 milliseconds, in particular from 1 to 10 milliseconds, very particularly preferably from 1 to 5 milliseconds. Gas pressure pulses can be produced in this way. In an embodiment of the process, the gas pressure pulses are produced at a frequency (pulse frequency) of from 1 Hz to 500 Hz, in particular at a frequency of from 5 Hz to 100 Hz, very particularly preferably at a frequency of 10 Hz to 40 Hz. Opening and closing of a gas pressure nozzle operated in such a way or of a valve used can be effected, for example, electromagnetically and/or piezoelectrically. In particular, a gas pressure pulse can be obtained using compressed air or compressed gas (for example carbon dioxide, nitrogen or the like). In particular, short, strong gas pressure pulses make it possible to avoid unnecessarily strong swirling-up of the particulate substance. Furthermore, blowing away of the substance and/or unnecessary dust generation can be reduced or even avoided. The pulse duration and the pulse frequency of the gas pressure pulses used determine, in particular, the amount of particulate substance supplied per unit time and thus a result of the scattering, in particular a density of abrasive grains, on the abrasive article substrate sprinkled with particulate substance.

The particulate substance is deagglomerated, in particular to give individual grains, by gas pressure pulses before being sprinkled on an abrasive article substrate. The loose constituents, i.e. the individual grains of the particulate substance, are often joined to one another as a result of attractive forces (for example van der Waals forces) acting among the individual grains and thus form agglomerates. Agglomerates typically appear as "lumpy" pulverulent material, "lumpy" powder or "lumpy" bulk material. The expression "deagglomeration" refers to breaking-up of agglomerates which are typically formed in a particulate substance, in particular a pulverulent material, a powder or a particulate bulk material. These agglomerates can in principle be broken up completely into the individual grains. In particular, the expression deagglomeration is also used when agglomerates in the particulate substance, in particular in the pulverulent material, in the powder or in the particulate bulk material, are at least partially broken up or at least partially degraded by deagglomeration. Agglomerates can advantageously be broken up or decreased to less than 10% (of their initial size), in particular broken up or decreased to less than 5%, very particularly preferably broken up or decreased to less than 1%, by deagglomeration. In particular, the agglomerates are broken up to the size of a few individual grains or of one individual grain.

The deagglomerated particulate substance can subsequently be sprinkled onto the abrasive article substrate. In an embodiment of the process, the deagglomerated particulate substance is sprinkled electrostatically onto the abrasive article substrate. Here, the particulate substance is electrostatically charged in an external electric field by electrostatic interaction with this external electric field and accelerated onto the abrasive article substrate. As an alternative or in addition, the deagglomerated particulate substance is sprinkled mechanically or gravimetrically onto the abrasive article substrate. "Mechanical scattering" means, in particular, that the particulate substance is sprinkled by mechanical acceleration onto the abrasive article substrate. This can be carried out, for example, using a rotating centrifugal accelerator, i.e. similar to a rotating disk, in the case of which the deagglomerated substance is accelerated radially in an outward direction. As an alternative or in addition, gravimetric scattering can be realized using a "slide". "Gravimetric scattering" means that the particulate substance is scattered under the action of gravity onto the abrasive article substrate.

The process of the disclosure makes it possible to overcome disadvantages of the prior art. In particular, a sprinkling of finely particulate substances, for example abrasive grains having an average particle size of #2000 in accordance with the FEPA standard, equivalent to an average abrasive grain size of about 10 microns, presents difficulties when employing processes of the prior art. The particulate substances to be sprinkled are "clumped together" by formation of agglomerates and lumps or agglomerates of the particulate substances are likewise present on the abrasive article substrate after sprinkling. This effect is also all the more reinforced, the smaller the average particle sizes. The process of the disclosure allows finely particulate substances firstly to be deagglomerated using gas pressure pulses and subsequently be sprinkled onto an abrasive article substrate. This makes it possible to produce abrasive articles in which the finely particulate substance, in particular abrasive grains, have been sprinkled open over the abrasive article substrate even in the case of finely particulate substances which clump together. In the case of such open sprinkling, the particulate substance is uniformly distributed over the surface, with intermediate spaces between neighboring individual grains of the particulate substance, in particular the abrasive grains, being present on the surface. This in turn reduces the risk of clogging of the abrasive article surface during a grinding process since a "chip space" (free space between neighboring abrasive grains for removal of grinding dust) is provided on the abrasive article.

In an embodiment of the process, the particulate substance is, in particular immediately before deagglomeration, provided through a sieve, with the gas pressure pulses being directed by means of a gas pressure nozzle against the sieve. In particular, the particulate substance can be provided in stock in a vessel, for example in a funnel, which comprises an opening directed downward which is covered by means of the sieve. For example, the opening of a funnel can be directed in a downward direction and be covered by means of the sieve so that particulate substance trickling through the sieve is automatically replaced, in particular under the action of gravity, by particulate substance sliding down afterward. Here, the width, steepness, surface nature, etc., of the walls of the vessel, in particular of the funnel, are made so that the particulate substance to be sprinkled can automatically slide down in the direction of the sieve. The vessel serves both to store the particulate substance and to continuously make the particulate substance available. For the purposes of the present disclosure, the sieve is, in particular, a mesh or a grid. In an embodiment of the process, a mesh opening, or size of the openings of the sieve, is greater than the average diameter of the particulate substance (i.e. greater than the average diameter of the respective individual grains of the particulate substance), for example 800% greater, in particular 400% greater, very particularly preferably 200% greater. In this way, it can be ensured that deagglomerated individual grains of the particulate substance can trickle through the mesh openings of the sieve in the direction of passage but agglomerated constituents of the particulate substance cannot automatically trickle through the sieve or the mesh openings thereof and instead remain in the vessel, in particular directly at the sieve.

In an embodiment of the process, the gas pressure pulses are directed against the sieve in a direction which is essentially opposite to the direction of passage of the particulate substance through the sieve. In this way, the agglomerated constituents of the particulate substance present directly on the sieve (but still in the vessel) can be deagglomerated particularly effectively. The particulate substance which has been deagglomerated in this way can consequently trickle directly in the direction of passage through the sieve and is then available for sprinkling in deagglomerated form. In an embodiment of the process, the gas pressure pulses are directed against the sieve by means of the gas pressure nozzle at an angle between gas pressure nozzle and sieve which is in the range from 0° to 90°, in particular from 20° to 70°, very particularly preferably from 35° to 55°. In particular, dust formation can be reduced in this way. Furthermore, a turbulent flow can in this way be produced within the vessel and/or outside the sieve, leading to improved deagglomeration of the particulate substance. Furthermore, it can be ensured in this way that particulate substance exiting from the vessel does not reagglomerate on the gas pressure nozzle.

In an embodiment of the process, the particulate substance is provided through the sieve over an entire width of the abrasive article substrate, in particular over an entire width of the abrasive article substrate web, with gas pressure pulses being directed against the sieve by means of a gas pressure nozzle, in particular by means of a plurality of gas pressure nozzles. In this way, the process of the disclosure can advantageously be employed over an entire width of an abrasive article substrate web used in a roll-to-roll process. In particular, a deagglomerated particulate substance can simultaneously be provided and sprinkled onto the abrasive article substrate web over the entire width of the abrasive article substrate web. In particular, the vessel for provision of the particulate substance, the downward-directed opening and also the sieve which covers the opening and through which the particulate substance is provided can be made at least as wide as the abrasive article substrate web. Furthermore, in an embodiment of the process, a plurality of gas pressure nozzles can be arranged next to one another in a direction transverse to the direction of extension (and direction of movement) of the abrasive article substrate web, in particular parallel to one another, so that gas pressure pulses can simultaneously be directed against the sieve distributed over the entire width of the sieve. In particular, use of the plurality of gas pressure nozzles also allows metering of an amount of deagglomerated particulate substance provided over the width of the abrasive article substrate web, for example with operation of the individual gas pressure nozzles at different pulse frequencies and/or pressures and/or pulse durations. It may be pointed out that it is of course also possible for a plurality of vessels, a plurality of sieves, etc., to be arranged next to one another in the direction transverse to the direction of extension of the abrasive article substrate web instead of a large, continuous container including a continuous sieve. Furthermore, a transport mechanism (for example a transport screw) can be used in the vessel for uniform distribution and provision of the particulate substance.

Furthermore, a gas pressure nozzle or a plurality of gas pressure nozzles can be arranged movably, for example on a rail, a swiveling device or the like, in an embodiment of the process. In particular, the gas pressure nozzle or the plurality of gas pressure nozzles can in this way at least be made able to move in at least one or two directions in space parallel to the sieve. In this way, it can be ensured that cavities formed in the vessel while carrying out the process, in particular between the sieve and the (largely still agglomerated) abrasive-particulate substance above it, can be resolved in a targeted manner and thus be avoided by a variable direction in which gas pressure pulses are supplied. In particular, such cavities normally collapse as a result of slow movement of the gas pressure nozzles, followed by a varying direction of the gas pressure pulses supplied. In an alternative or additional embodiment of the process, a vibration generator can be provided on the vessel and/or on the sieve so as to ensure regular collapse of the cavities as a result of occasional or permanent vibration.

In an embodiment of the process, the sieve is made of metal and is operated as high-voltage electrode during electrostatic sprinkling. A counter electrode for the electrostatic sprinkling of the deagglomerated particulate substance can, for example, be arranged behind the abrasive article substrate, in particular behind the abrasive article substrate web, or be provided by the abrasive article substrate, in particular the abrasive article substrate web, itself, as long as this is electrically conductive or comprises an electrically conductive (e.g. aqueous or carbon black-filled) binder. In this way, it is possible to achieve particularly effective electrostatic sprinkling of the particulate substance, with a risk of reagglomeration of the previously deagglomerated particles being able to be largely avoided.

Furthermore, an abrasive article, in particular abrasive article web, which has been produced by the process of the disclosure is proposed. The abrasive article has a particulate substance, in particular abrasive grains, applied to the abrasive article substrate. Abrasive grains are known from the prior art. The particulate substance is coated directly onto the abrasive article substrate with the aid of a binder. The abrasive article has a surface intended for grinding, i.e. an abrasive surface, especially on the side of the abrasive article on which the abrasive grains are fixed and are optionally provided with a covering binder and/or a further additive. The abrasive surface of the abrasive article is moved over a workpiece to be worked during a grinding process, so that a grinding action is produced by means of the abrasive grains arranged on the abrasive surface. The abrasive article can in principle be present in various manufactured forms, for example as abrasive disk or as abrasive band, as sheet, roll, strip or else as abrasive article web (e.g. during production).

BRIEF DESCRIPTION OF THE DRAWINGS

The disclosure will be illustrated by working examples depicted in the drawings in the following description. The drawings, the description and the disclosure contain numerous features in combination. A person skilled in the art will advantageously also look at the features individually and combine them to give purposeful further combinations. Identical reference numerals in the figures denote identical elements.

The drawings show.

DETAILED DESCRIPTION

Figure 1:
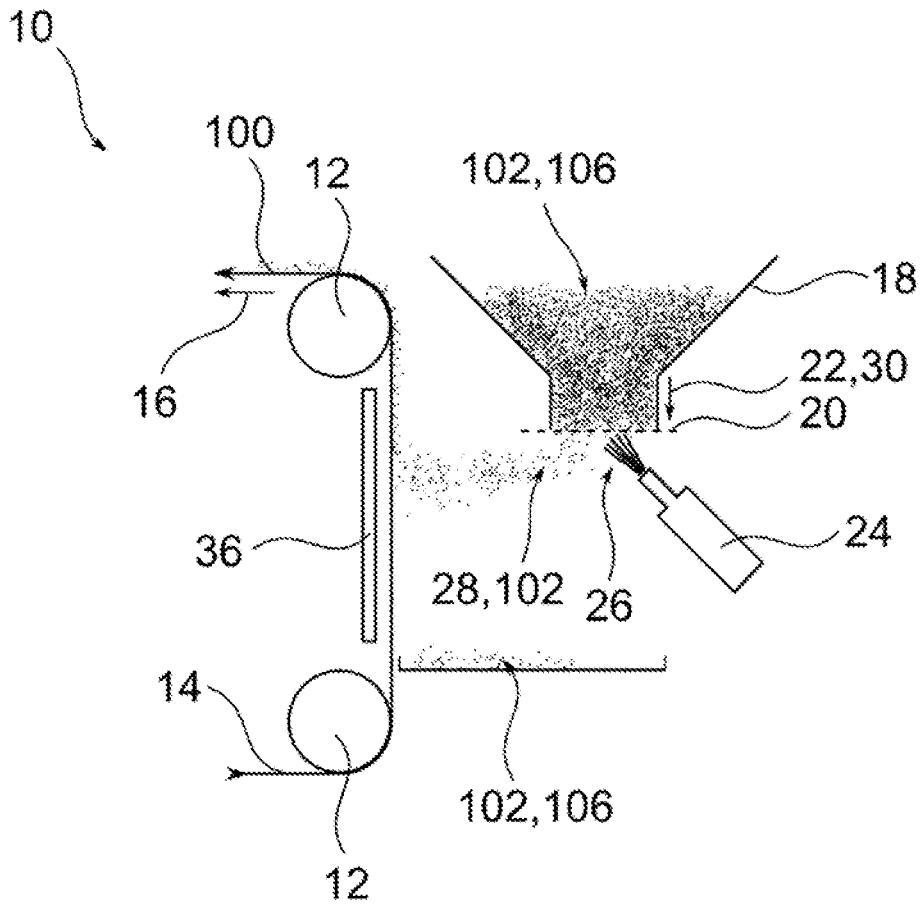
FIG. 1 a schematic side view of an illustrative embodiment of a sprinkling machine for carrying out the process of the disclosure.
Figure 2:
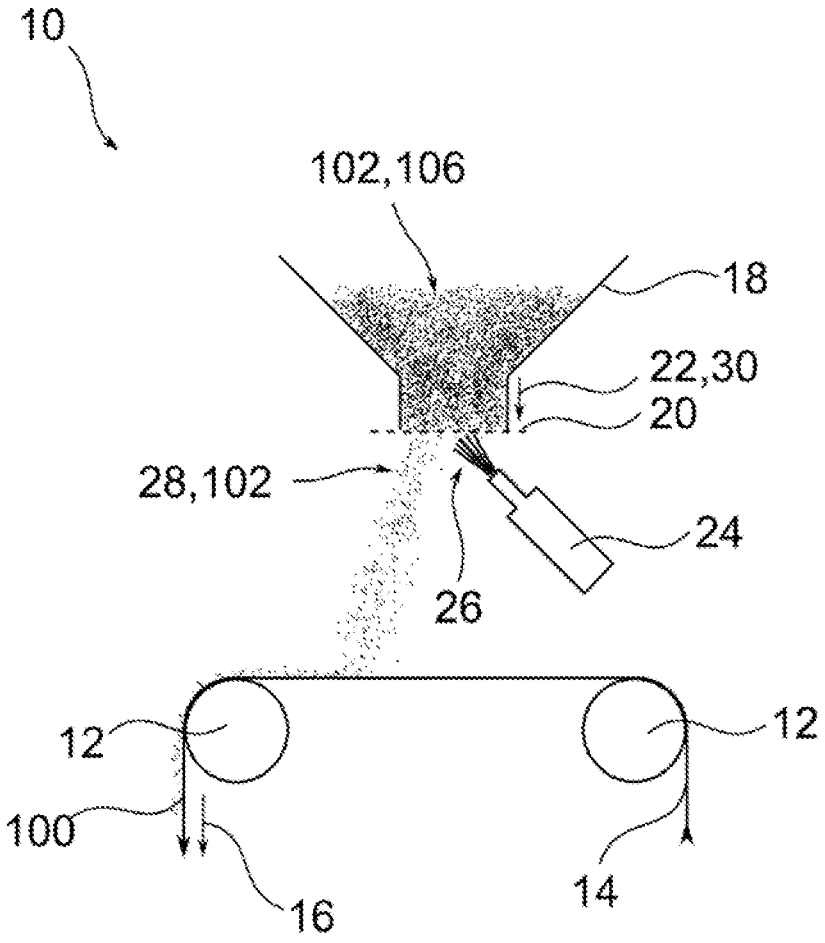
FIG. 2 a schematic side view of an alternative illustrative embodiment of a sprinkling machine for carrying out the process of the disclosure.
Figure 3:
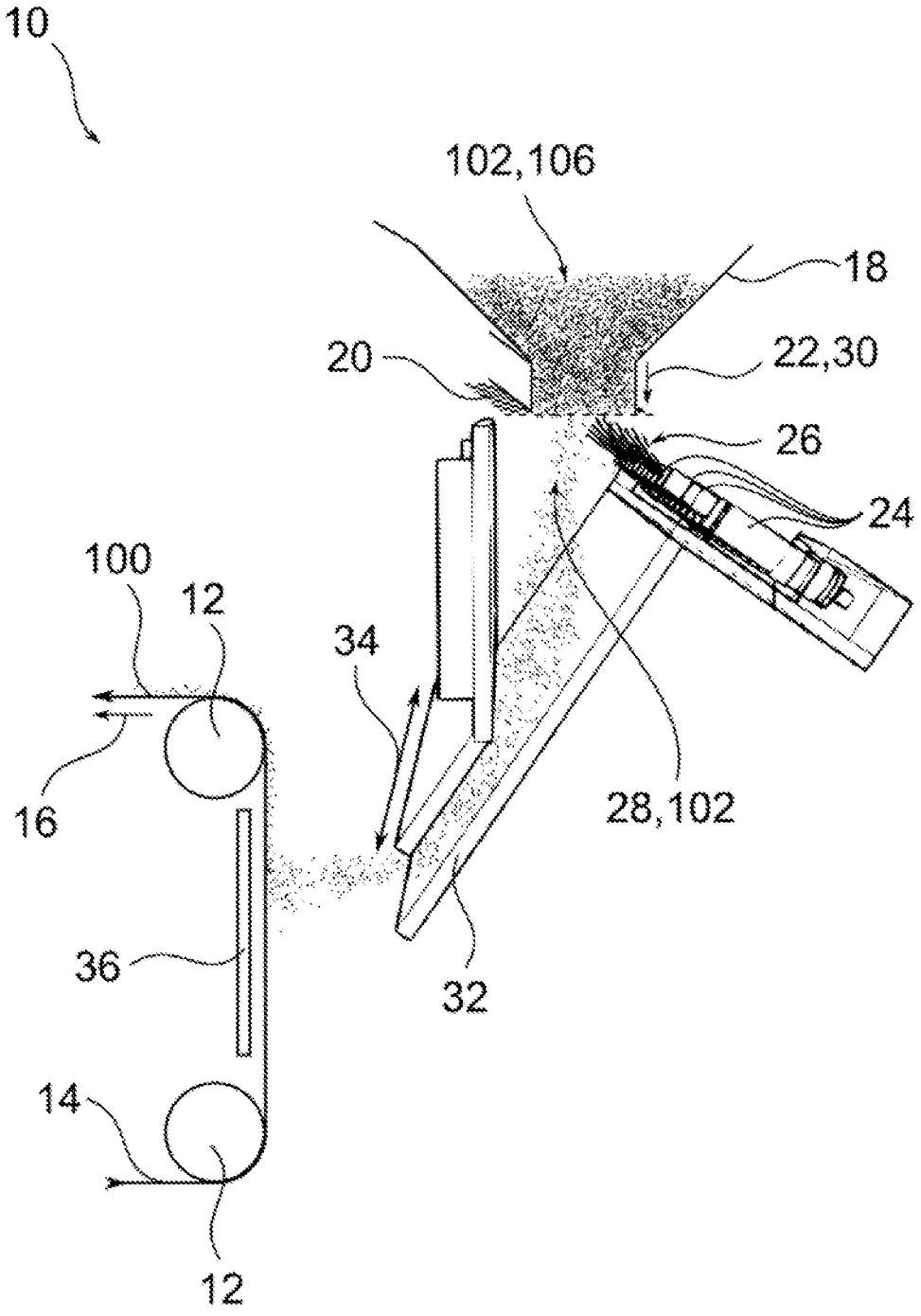
FIG. 3 a schematic side view of an alternative illustrative embodiment of a sprinkling machine for carrying out the process of the disclosure.

FIGS. 1, 2 and 3 each show a schematic side view of an illustrative embodiment of a sprinkling machine 10 (roll-to-roll machine) for carrying out the process of the disclosure for producing an abrasive article 100. The sprinkling machine 10 serves to sprinkle abrasive grains 102 as particulate substance onto an abrasive article substrate 104, here, in particular, in the form of an abrasive article substrate web 14.

In particular, the abrasive grains can have an average particle size of less than 50 microns, for example abrasive grains of the FEPA type #2000, which have an average diameter of about 10 microns. Such abrasive grains are typically present in the form of an at least partially agglomerated powder 106 because of their small size.

The sprinkling machine 10 has two transport rollers 12 which serve to rollably support the abrasive article substrate web 14. In FIGS. 1-3, the abrasive article substrate web 14 is conveyed counterclockwise by means of the transport rollers 12 in the direction of extension 16 of the abrasive article substrate web 14. A roll carrier for continuously rolling off the input material, i.e. the abrasive article substrate web 14, is not shown in each of the FIGS. 1-3. The abrasive article 100 produced by the process of the disclosure, i.e. the sprinkled abrasive article substrate web 14, is rolled up onto roll carriers which are likewise not shown in FIGS. 1-3. The incoming abrasive article substrate web 14 is, in all embodiments of the sprinkling machine shown, already coated with a binder (not shown in more detail here). The features of the sprinkling machine 10 for coating the abrasive article substrate web 14 with the binder, for example a spray apparatus or the like, are not shown in more detail in each of the FIGS. 1-3.

The sprinkling machine 10 in FIGS. 1-3 further comprises, in each case, a vessel 18, in particular a funnel, for provision of abrasive grains 102. The container 18 is open at the bottom (in a downward direction 30), with the opening being covered by means of a sieve 20. Abrasive grains 102 supplied by the vessel 18 can thus get out of the vessel 18 only through the sieve 20, and leave the sieve 20 in the direction of passage 22. The sieve 20 has a mesh opening which is about four times the average diameter of the abrasive grains. In one working example, abrasive grains of the FEPA type #2000, having an average diameter of about 10 microns, are sprinkled onto the substrate, with the sieve 20 having a mesh opening of about 42 microns.

The sieve 20 is subjected from below to gas pressure pulses 26, i.e. to a pulsed gas stream, using at least one gas pressure nozzle 24. In particular, the gas pressure pulses 26 are directed in the form of pulsed air pressure pulses against the sieve 20 from below in a direction essentially opposite to the direction of passage 22. The gas pressure nozzle 24 is oriented at an angle of 45° relative to the plane of the sieve 20, so that the gas pressure pulses 26 are directed against the sieve 20 with a grazing incidence relative to the sieve 20. The gas pressure pulses 26 are produced at a frequency of 30 Hz with an average duration of 5 milliseconds and with a pressure of 7 bar and directed against the sieve 20.

The at least partially agglomerated abrasive grains 102 which are provided in the vessel 18 and are present directly on the sieve 20 are deagglomerated by the gas pressure pulses 26. This forms an abrasive grain cloud 28 which exits from the sieve 20 in the direction of passage 22 and is subsequently sprinkled on the abrasive article substrate web 14.

In FIG. 1, sprinkling of the deagglomerated abrasive grains 102 is effected electrostatically. Here, the sieve 20 is made of metal and is operated as high-voltage electrode during electrostatic sprinkling. Behind, viewed from the sieve 20, the abrasive article substrate web 14, there is a counterelectrode 36 in the direction of which the abrasive grains 102 are accelerated in the electric field and are thus accelerated against the abrasive article substrate web 14. Electrostatic sprinkling is known to a person skilled in the art. The advantage of arranging the abrasive article substrate web 14 at the side of the vessel 18 is that it reduces the probability of agglomerates of abrasive grains 102 reformed after deagglomeration, for example as a result of collisions between abrasive grains 102, subsequently being sprinkled onto the abrasive article substrate web 14, since these drop down before reaching the abrasive article substrate web 14 because of their greater weight. A collection pan for agglomerates 106 which fall down can optionally be provided under the vessel 18.

In FIG. 2, sprinkling of the deagglomerated abrasive grains 102 occurs gravimetrically. The abrasive grains 102 are accelerated from the abrasive grain cloud 28 essentially in the downward direction 30 under the action of gravity due to their intrinsic weight and are thus accelerated against the abrasive article substrate web 14 which is conveyed horizontally underneath. Gravimetric sprinkling is known to a person skilled in the art.

FIG. 3 depicts a further alternative working example in which the deagglomerated abrasive grains 102 firstly trickle gravimetrically onto an inclined plane 32 on which they likewise slide under the action of gravity. The inclined plane 32 is made of metal and is operated as a high-voltage electrode so that the abrasive grains 102 become electrostatically charged as they move over the inclined plane 32. The electrostatic charging results in the abrasive grains 102 being repelled by one another and thus becoming distributed uniformly spaced over the inclined plane 32, especially in the direction of their sliding movement and also in the lateral direction (i.e. in the direction into the plane of the image, cf. direction of the width 34). When the abrasive grains 102 have arrived at the end of the inclined plane 32, they are electrostatically sprinkled onto the abrasive article substrate web 14 which, in a manner similar to FIG. 1, is oriented vertically and is moved along the inclined plane 32. The uniform distribution of the abrasive grains 102 using the inclined plane 32 operated as high-voltage electrode has an advantageous effect on the uniform arrangement of the sprinkled abrasive grains 102 on the abrasive article.

Furthermore, it can be seen in FIG. 3 that the abrasive grains 102 are provided by the sieve 20 over the entire width 34 of the abrasive article substrate web 14, with gas pressure pulses 26 being directed against the sieve 20 by means of a plurality of gas pressure nozzles 24. In this way, the abrasive article substrate web 14 can be sprinkled with abrasive grains 102 over the entire width 34. It may be pointed out that the use of a plurality of gas pressure nozzles 24 to produce gas pressure pulses 26 can likewise be realized in the arrangements of FIGS. 1 and 2.

Figure 4:
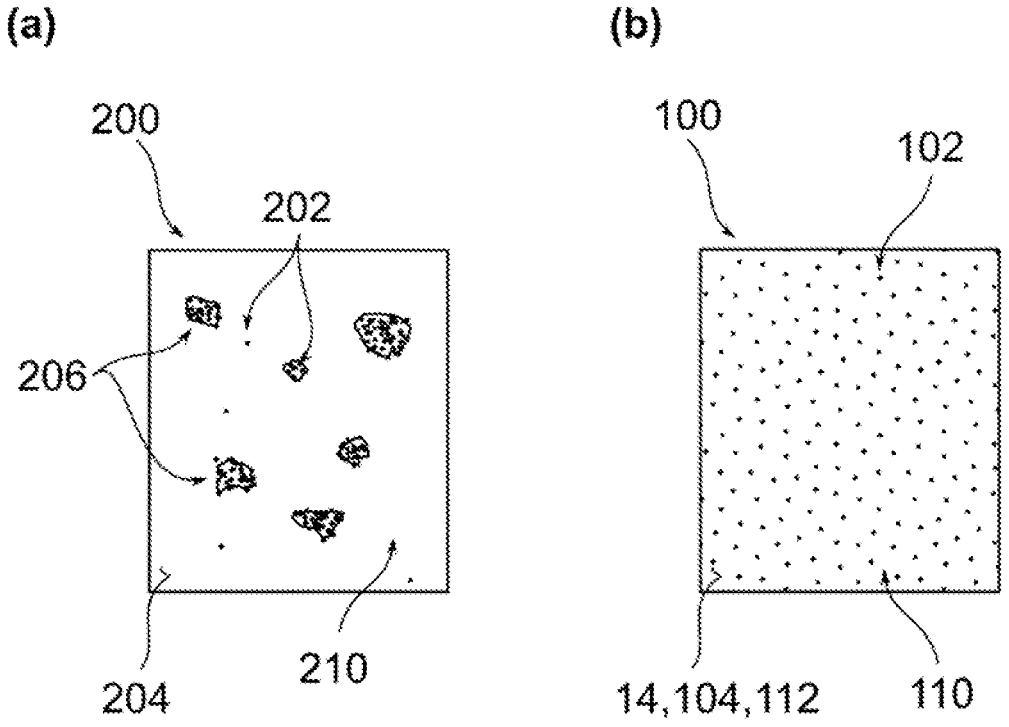
FIG. 4*a* a schematic plan view onto an illustrative abrasive article produced by a process of the prior art.
FIG. 4*b* a schematic plan view onto an illustrative abrasive article produced by the process of the disclosure.

FIG. 4*a* shows a schematic plan view onto an abrasive article 200 which has been produced by a process of the prior art. Difficulties are typically encountered here, since the abrasive grains 202 are agglomerated or "clumped" and are accordingly likewise sprinkled in the form of clumped agglomerates 206 onto the abrasive article substrate 204 in an electrostatic or gravimetric sprinkling process. Irregularly applied, clumped abrasive grain agglomerates 206 are formed on the surface of the abrasive article substrate 204. In order for the abrasive grain agglomerates 206 not to produce scratch marks on the surface of the abrasive article substrate 204 in a later grinding process, the abrasive grain agglomerates 206 subsequently have to be blown off, knocked off, brushed off or washed off, and excess abrasive grains 202 become distributed over the free areas 210 between the abrasive grain agglomerates 206 so as to clog the entire surface area of the abrasive article 200 produced (not shown in more detail here). For this reason, an abrasive article 200 having a surface closed by abrasive grains 202 is typically formed in processes of the prior art.

The process of the disclosure, on the other hand, makes it possible firstly to deagglomerate abrasive grain powders which have become clumped and agglomerated by attractive forces between individual abrasive grains 102 into individual abrasive grains 102 and then subsequently to sprinkle the deagglomerated abrasive grains 102. This makes it possible to produce an open surface of the abrasive article 100, in which the abrasive grains 102 are distributed uniformly and with a spacing on the surface of the abrasive article 100. FIG. 4*b* shows a schematic plan view onto an abrasive article 100 which has been produced in this way. It can be seen that the abrasive grains 102 are uniformly distributed over the surface of the abrasive article substrate 104, in particular over the surface of the abrasive article substrate web 14. Free areas 110 between neighboring abrasive grains 102 are likewise present and are relatively uniform.

Figure 5:
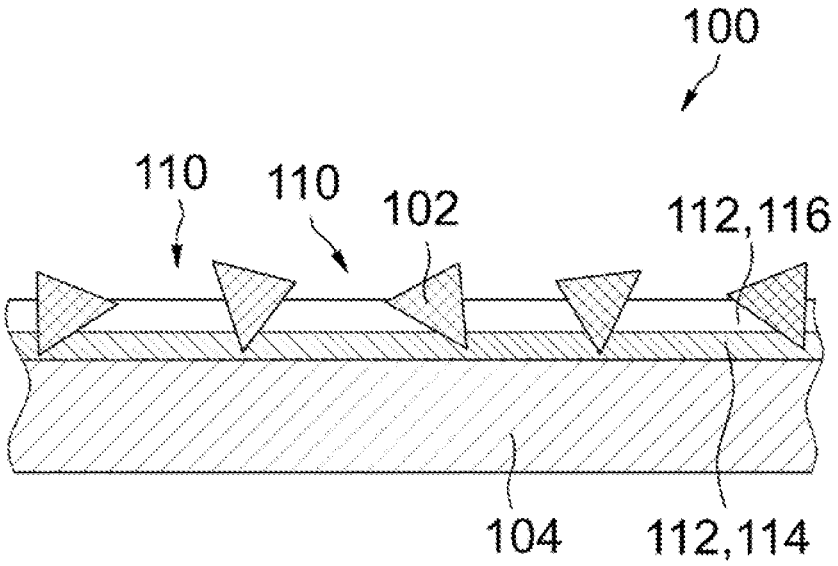
FIG. 5 a schematic sectional view of an abrasive article produced by the process of the disclosure.

FIG. 5 finally shows a section of an illustrative embodiment of an abrasive article 100 according to the disclosure with abrasive grains 102 in a schematic sectional view. In the embodiment depicted, the abrasive article 100 is a coated abrasive article 100 having an abrasive article substrate 104. The abrasive article substrate 104 serves as flexible substrate for the abrasive grains 102. The abrasive grains 102 are fastened by means of a binder 112, in particular a base binder 114, which is, for example, in the form of phenolic resin, onto the abrasive article substrate 104. The layer of base binder 114 and abrasive grains 102 is additionally coated with a covering binder 116, in particular likewise composed of phenolic resin. The abrasive grains 102 have been sprinkled on using the process of the disclosure. This results in regular free areas 110 between neighboring abrasive grains 102 and thus an open surface of the abrasive article 100.

The invention claimed is:

1. A process for producing an abrasive article, comprising:

deagglomerating a particulate substance using gas pressure pulses;

sprinkling an abrasive article substrate coated with binder with the deagglomerated particulate substance; and providing the particulate substance through a sieve, with the gas pressure pulses being directed by a gas pressure nozzle against the sieve.

2. The process as claimed in claim 1, wherein the gas pressure pulses are directed against the sieve essentially in a direction opposite to a direction of passage of the particulate substance through the sieve.

3. The process as claimed in claim 1, wherein the gas pressure pulses are directed against the sieve by the gas pressure nozzle at an angle between the gas pressure nozzle and the sieve which is in a range from 0° to 90°.

4. The process as claimed in claim 1, wherein a mesh opening of the sieve is greater than an average diameter of the particulate substance.

5. The process as claimed in claim 1, wherein:

the abrasive article substrate is an abrasive article substrate web;

the particulate substance is provided through the sieve over an entire width of the abrasive article substrate web; and the gas pressure nozzle is one of a plurality of gas pressure nozzles delivering gas pressure pulses against the sieve.

6. The process as claimed in claim 1, wherein the particulate substance comprises abrasive grains.

7. The process as claimed in claim 1, wherein the particulate substance has an average particle size of less than 300 microns.

8. The process as claimed in claim 1, wherein the gas pressure pulses are produced at a frequency of from 1 Hz to 500 Hz.

9. The process as claimed in claim 1, wherein the gas pressure pulses have an average duration in a range from 0.5 to 30 milliseconds.

10. The process as claimed in claim 1, wherein the gas pressure pulses have a pressure of more than 0.5 bar.

11. The process as claimed in claim 1, wherein the deagglomerated particulate substance is sprinkled electrostatically onto the abrasive article substrate.

12. The process as claimed in claim 11, wherein the sieve is made of metal and is operated as a high-voltage electrode during electrostatic sprinkling.

13. The process as claimed in claim 1, wherein the deagglomerated particulate substance is sprinkled mechanically or gravimetrically onto the abrasive article substrate.

14. The process as claimed in claim 1 wherein the gas pressure pulses are directed against the sieve by the gas pressure nozzle at an angle between the gas pressure nozzle and the sieve which is in a range from 35° to 55°.

15. The process as claimed in claim 1, wherein a mesh opening of the sieve is 400% greater than an average diameter of the particulate substance.

16. The process as claimed in claim 1, wherein the particulate substance has an average particle size of less than 50 microns.

17. The process as claimed in claim 1, wherein the gas pressure pulses are produced at a frequency of from 10 Hz to 40 Hz.

18. The process as claimed in claim 1, wherein the gas pressure pulses have an average duration in a range from 1 to 5 milliseconds.

* * * * *